US011447917B2

(12) United States Patent
Reiser

(10) Patent No.: US 11,447,917 B2
(45) Date of Patent: Sep. 20, 2022

(54) DEVICE FOR MOVING A TONGUE RAIL OF A SWITCH

(71) Applicant: WIELAND AUSTRIA GES.M.B.H., Amstetten (AT)

(72) Inventor: Georg Reiser, Baden (AT)

(73) Assignee: WIELAND AUSTRIA GES.M.B.H., Amstetten (AT)

( * ) Notice: Subject to any disclaimer, the term of this patent is extended or adjusted under 35 U.S.C. 154(b) by 272 days.

(21) Appl. No.: 16/473,012

(22) PCT Filed: Nov. 17, 2017

(86) PCT No.: PCT/AT2017/060303

§ 371 (c)(1),
(2) Date: Jun. 24, 2019

(87) PCT Pub. No.: WO2018/119483

PCT Pub. Date: Jul. 5, 2018

(65) Prior Publication Data

US 2020/0385933 A1 Dec. 10, 2020

(30) Foreign Application Priority Data

Dec. 29, 2016 (AT) ..... A 51192/2016

(51) Int. Cl.
*E01B 7/02* (2006.01)

(52) U.S. Cl.
CPC ..... *E01B 7/02* (2013.01); *E01B 2202/025* (2013.01); *E01B 2202/044* (2013.01)

(58) Field of Classification Search
CPC ..... E01B 7/02; E01B 2202/025; E01B 2202/044; E01B 2202/046; E01B 2202/04;
(Continued)

(56) References Cited

U.S. PATENT DOCUMENTS 5,501,418 A * 3/1996 Humphrey ..... E01B 7/02 246/453
7,766,283 B2 * 8/2010 Lesemann ..... E01B 7/02 246/453
(Continued)

FOREIGN PATENT DOCUMENTS

DE 102005032417 A1 1/2007
DE 102014212074 A1 * 12/2015 ..... E01B 7/02
(Continued)

*Primary Examiner* — Zachary L Kuhfuss
*Assistant Examiner* — Cheng Lin
(74) *Attorney, Agent, or Firm* — Dykema Gossett PLLC

(57) ABSTRACT

A device for moving a tongue rail of a railway switch, comprising at least two rollers arranged one behind the other and substantially parallel to the course of the rail, on which rollers the tongue rail can roll up from a lower abutting position on the stock rail and directly in front of the first roller onto the first roller, and can roll on to another roller until the tongue rail reaches an open switch remote, wherein at least one additional intermediate roller that is smaller than the rollers, is provided in the space between the rollers, and wherein the axis of rotation of the intermediate roller is arranged substantially parallel to the axes of rotation of the rollers.

18 Claims, 4 Drawing Sheets

(58) Field of Classification Search
CPC ..... E01B 2202/042; E01B 2202/048; E01B 2202/06; E01B 7/00–7/30
See application file for complete search history.

(56) References Cited

U.S. PATENT DOCUMENTS

| | | | | |
|---|---|---|---|---|
| 2002/0079634 | A1 | 6/2002 | Lesemann | |
| 2008/0087773 | A1 * | 4/2008 | Meyer | E01B 7/02 246/453 |

FOREIGN PATENT DOCUMENTS

| | | | | |
|---|---|---|---|---|
| EP | 0964100 | A2 * | 12/1999 | E01B 7/02 |
| EP | 2995718 | A1 | 3/2016 | |
| JP | 2003034248 | A | 2/2003 | |
| JP | 2007332696 | A | 12/2007 | |
| KR | 20120066440 | A1 | 6/2012 | |

* cited by examiner

DEVICE FOR MOVING A TONGUE RAIL OF A SWITCH

CROSS-REFERENCE TO RELATED APPLICATIONS

This application is a national stage filing based upon International PCT Application No. PCT/AT2017/060303, filed 17 Nov. 2017, which claims the benefit of priority to Austria application No. A 51192/2016, filed 29 Dec. 2016.

BACKGROUND

The invention relates to a device for moving a tongue rail of a switch, having at least two rollers arranged one behind the other and essentially parallel to the rail course, on which the tongue rail can roll up from a lower contact position on the stock rail and directly in front of the first roller onto the first roller, and can roll on to the further rollers until it reaches a remote position.

Devices for moving tongue rails of switches must be able to transport the tongue rail sufficiently far at points of the switch to enable a rail vehicle to drive over it safely. However, the movement of the tongue rail must be as low-friction as possible in order to prevent unnecessary wear. At the same time, large forces act on the rails when heavy vehicles are driven over, which is why it is important to ensure that the switch as a whole and especially a device for moving tongue rails are designed as robust as possible. For this reason, systems have already been developed which have roller arrangements which require the tongue rail to be rolled up from the lower contact position adjacent to the stock rail, so that it can be transported away from the stock rail on the rollers.

From the US 2002/0079634 A1 a device is known, which has tiltable rollers, which enables a rolling up of the tongue rail. After rolling up, the tongue rail is guided on further rollers. Systems of this type, however, have the problem of high maintenance costs, as they are quite complicated in structure. In addition, they are very susceptible to errors due to the weather, as dirt and icing can occur despite tight maintenance and monitoring.

A further problem of already known solutions is the safe transport of the tongue rail, even with small foot widths. If the profile of the tongue rail is very narrow, as for example with rails according to the American AREMA standard, the rail can sink between the rollers, rub against the surface and cause undesirable wear and disturbances.

Solutions are known from the DE 102007 038 653 A1 and the JP 2003 34248 A, which enable rolling up directly onto an adjacent large roll. Several rollers are provided, which are arranged offset to each other so that a sinking between the rollers is prevented. However, by displacing the rollers, these solutions cause a torque to act on the device, which represents an additional load. The resulting shortened period of use is disadvantageous. In addition, the resulting increase in overall width can lead to problems with the arrangement of the device between two sleepers.

SUMMARY OF THE INVENTION

It is therefore the object of the present invention to overcome the described problems and to provide a device for moving a tongue rail of a switch, which at the same time ensures the smoothest possible movement of the tongue rail while being as robust as possible, in particular preventing the tongue rail from sinking, and which is loaded as little as possible during its use in order to achieve the longest possible and low-maintenance service life.

This is solved in accordance with the invention by providing at least one further intermediate roller, which is smaller than the rollers, in the space between two adjacent rollers, wherein the axis of rotation is essentially parallel to the axes of rotation of the rollers.

On the one hand, the introduction of smaller intermediate rollers between the rollers prevents unnecessary torque loads from acting on the device. On the other hand, the roller size of the rollers can be selected so large that it can be rolled up as easily and frictionlessly as possible without running the risk of the tongue rail sitting between the rollers. The linear design also makes the device more compact and less complex, as the retaining devices for the rollers can be combined.

The rollers and intermediate rollers can be arranged in different positions relative to each other. Thus, the highest points of the shells of the rollers and the intermediate rollers can be at the same height, in order to facilitate the lightest possible rolling of the tongue rail. However, it can be particularly advantageous to arrange the intermediate rollers relative to the rollers in such a way that the highest point of the intermediate roller shell is slightly below the highest points of the roller shell. This can be particularly important if the rollers have different designs and different elasticities as a result.

If the rollers, especially the first roller, are designed as elastomer-sprung rollers, this optimizes the movement of the tongue rail on the rollers and also the rolling up. The suspension reduces the wear of the rollers and the tongue rail, at the same time suspension by the elastomer layer provides a mechanical solution that is as compact as possible, less prone to faults and low in maintenance. Such an elastomer suspension can be realized, for example, by a roller which has a hub made of preferably less elastic, stable material, therefore an inner elastomer layer and an outer thin metal layer. The latter metal layer prevents damage to the elastomer layer by rolling on or rolling over the roller or intermediate roller. However, all or parts of the rollers and intermediate rollers can also be made of other materials or entirely of metal.

Particularly noteworthy is the possibility of designing the rollers as elastomer-sprung rollers and making the intermediate rollers available in low-elastic material such as steel. This makes it easy to roll up and move along the rollers without friction. This is particularly advantageous if the intermediate rollers, as described above, do not form a roller plane of the same height with the rollers, but are slightly offset downwards in relation to them. This is because even if the elastomer-sprung rollers are slightly deformed while the tongue rail is rolling on them, there is no undesirable slight rolling up onto the intermediate rollers, which could lead to material wear. The tongue rail is lowered slightly when rolling on the intermediate rollers, but this does not damage it, as it is easy to roll on to the next elastomer-sprung roller due to the small difference in height.

If rollers and intermediate rollers, or at least parts of them, are arranged on a common retaining device, this has advantages, in particular with regard to the easy manufacture of the device segments. In addition, the mechanical stability of the roller system is particularly well ensured. It is also advantageous if the retaining device consists of two laterally arranged parts, between which the rollers can be placed. This compact and simple, cost-saving design reveals a particularly inexpensive solution that is not prone to errors.

If the rollers are designed at least partially height-adjustable, the device can easily be adapted to the conditions on site or readjusted if necessary. This is particularly important as the height of the rollers must be optimized. On the one hand, they should be slightly higher relative to the bearing surface on which the tongue rail rests in the abutting position in order to prevent friction during rolling. On the other hand, it is advantageous to keep the described height difference between the roller level and the supporting surface small so that rolling onto the first roller is easily possible.

The solution of arranging the rollers and intermediate rollers on a common retaining device, which is height-adjustable, is particularly advantageous. This makes it possible to adjust the intermediate roller together with the setting of the other rollers, resulting in a particularly easy to use and easily adjustable solution.

The device can be attached to the switch in a variety of ways depending on the situation. Particularly noteworthy are the possibilities of fixing the device between two sleepers or attaching it to the stock rail.

Depending on the distance that the tongue rail must reach relative to the stock rail in the remote position, it may be advantageous to arrange a further intermediate roller distal to the stock rail after the last roller in order to further increase the maximum achievable rolling distance.

BRIEF DESCRIPTION OF THE DRAWINGS

In the following, the present invention will be explained in more detail by reference to the embodiment variants depicted in the figures, wherein.

DETAILED DESCRIPTION

Figure 1:
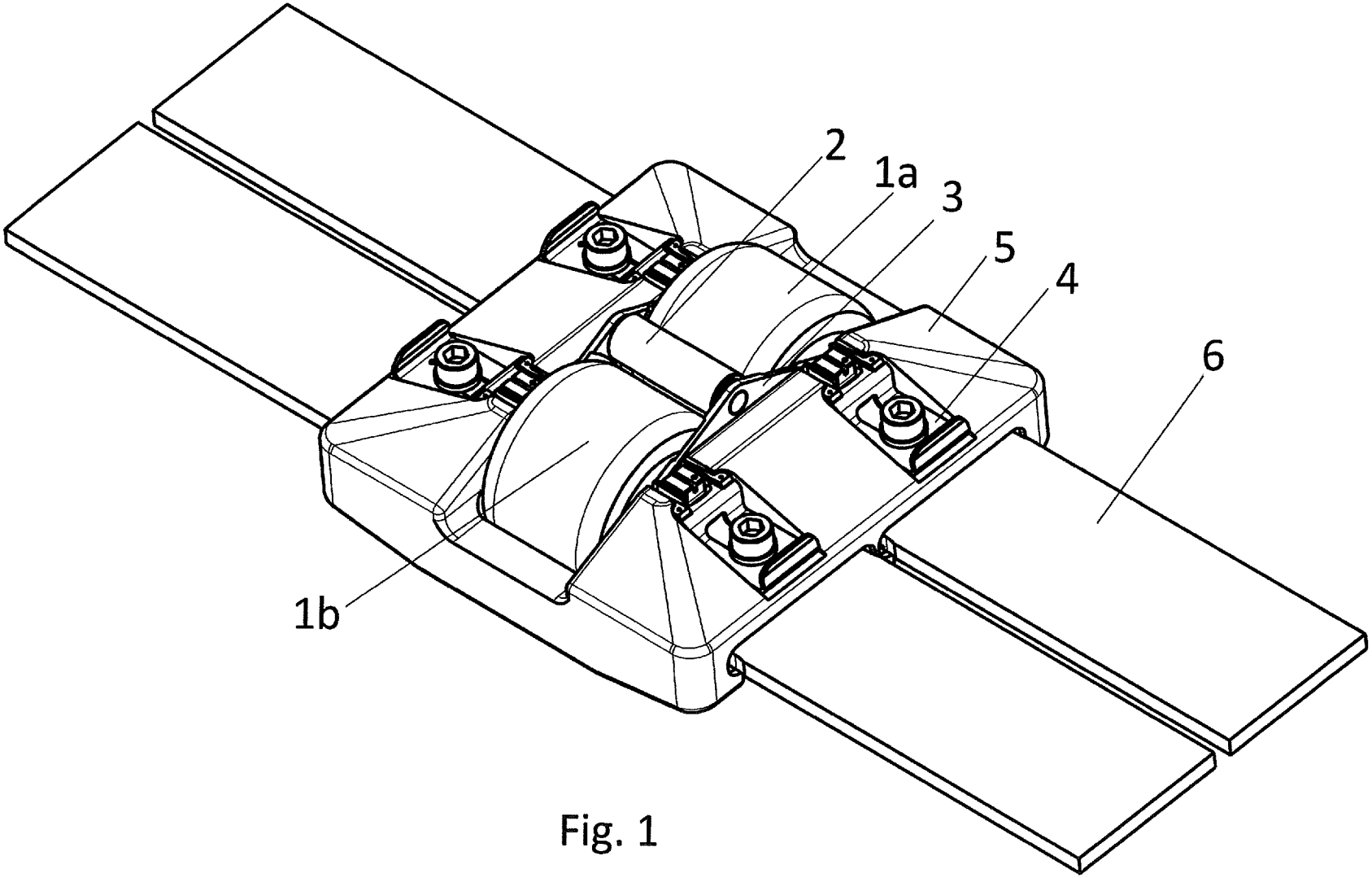
FIG. 1 shows a perspective view of an embodiment.

In FIG. 1, an embodiment is disclosed which is arranged between and attached to two sleepers which are not shown. For this purpose four leaf springs 6 are attached to the sides of a carrier body 5, which can be attached to the sleepers in fastening shoes not shown. This type of fastening allows the device to be moved between the sleepers along an axis parallel to the sleepers. Optimally, the device is moved close to the tongue rail during installation and fastened so that the tongue rail rests directly against the shell of the first roller 1. Fastening methods are already known, as disclosed by EP 0 654 561 A1. Two rollers 1*a*, 1*b* and an intermediate roller 2 are provided, which are arranged together on the retaining device 3, consisting of two opposite metal elements. Rollers 1*a*, 1*b* and intermediate roller 2 are arranged so that their axes of rotation are parallel. The diameter of the rollers 1*a*, 1*b* is selected so large that it is easy to roll up a tongue rail from the contact position. The diameter of the intermediate roller 2 is in any case smaller than half the diameter of the rollers 1*a*, 1*b*; in the case shown it is approx. a quarter of the diameter of the rollers 1*a*, 1*b*. The rollers 1*a*, 1*b* and the intermediate roller 2 are arranged very close to each other in order to avoid a possible sinking between the rollers 1*a*, 1*b* and the intermediate roller 2 even if the foot width is particularly narrow. Adjusting devices 4 are provided at the height of the axes of rotation of rollers 1*a*, 1*b*, by means of which the height of the axes of rollers 1*a*, 1*b* can be adjusted individually. The intermediate roller 2 does not have to be adjusted separately but is adjusted by the common retaining device 3 with the rollers 1*a*, 1*b*. The rollers 1*a*, 1*b* and the intermediate roller 2 are arranged in such a way that the highest points 1*ah*, 1*bh*, 2*h* of the shells of the rollers 1*a*, 1*b* or the intermediate roller 2 are approximately in a horizontal plane E in cross-section. Optionally, the highest point 2*h* of the shell of the intermediate roll 2 is slightly below this plane E, namely by the extent of the possible deformation of the first roll 1*a*. Plane E is slightly above the upper edge of the carrier body 5.

Figure 2:
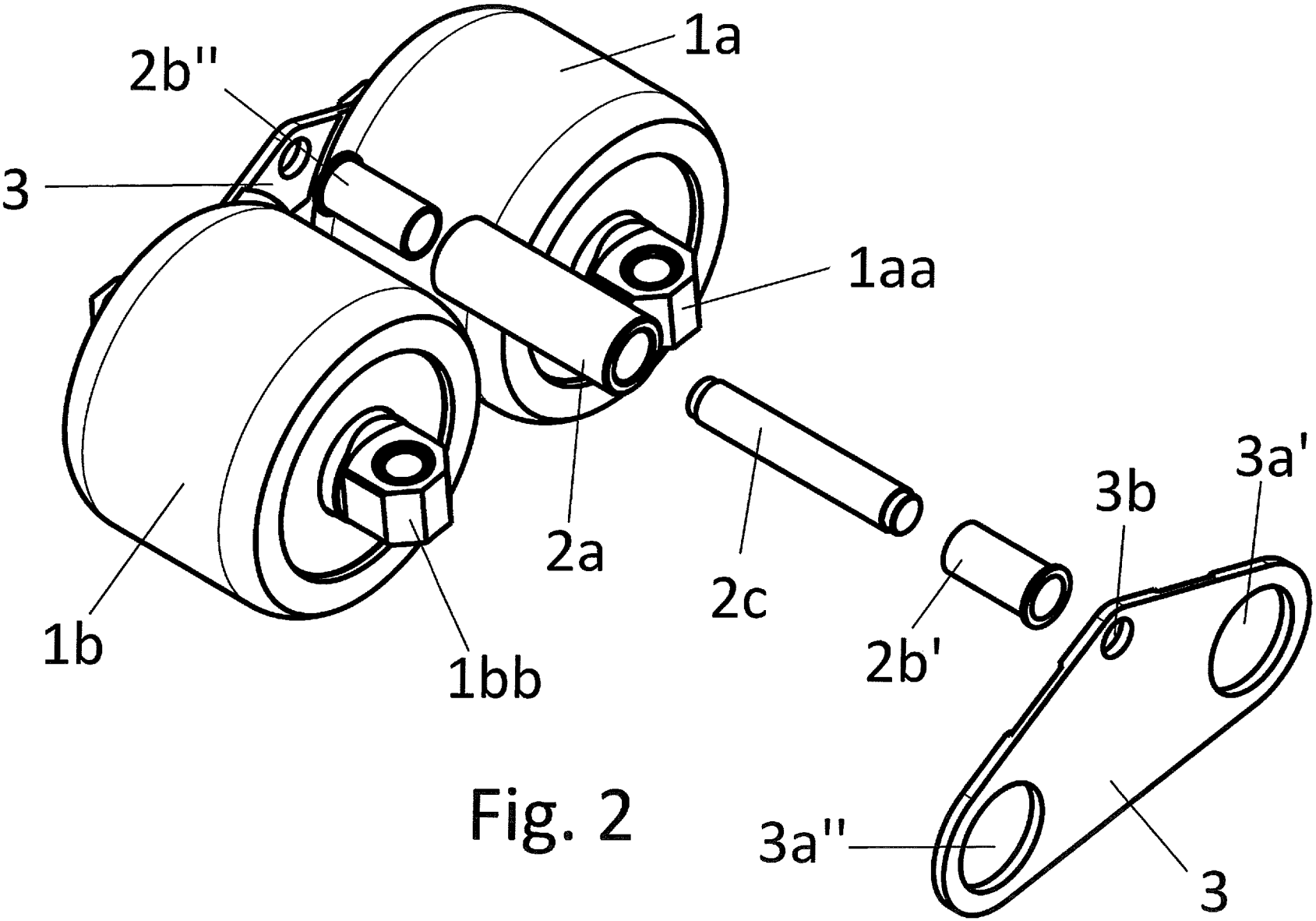
FIG. 2 shows an exploded view of an inner segment of the same embodiment.

FIG. 2 discloses an inner segment of the embodiment described in FIG. 1. It shows that the retaining element 3 consists of two opposite metal elements, each with three holes 3*a*', 3*a*", 3*b*. The shafts 20 of the rollers 1*a*, 1*b* run through two large holes 3*a*', 3*a*", and the shaft 2*c* of the intermediate roller 2 runs through a smaller hole 3*b* in the middle of the upper part. This intermediate roller 2 consists of an outer shell 2*a*, two middle sleeves 2*b*', 2*b*" and a shaft 2*c*. The individual elements 2*a*, 2*b*", 2*b*" and 2*c* are inserted into each other to form the intermediate roller 2. The shafts of the rollers 1*a*, 1*b* have fastening elements 1*aa*, 1*bb* outside the roller 1*a*, 1*b* which have holes in order to be optimally connectable to the adjusting device 4.

Figure 3:
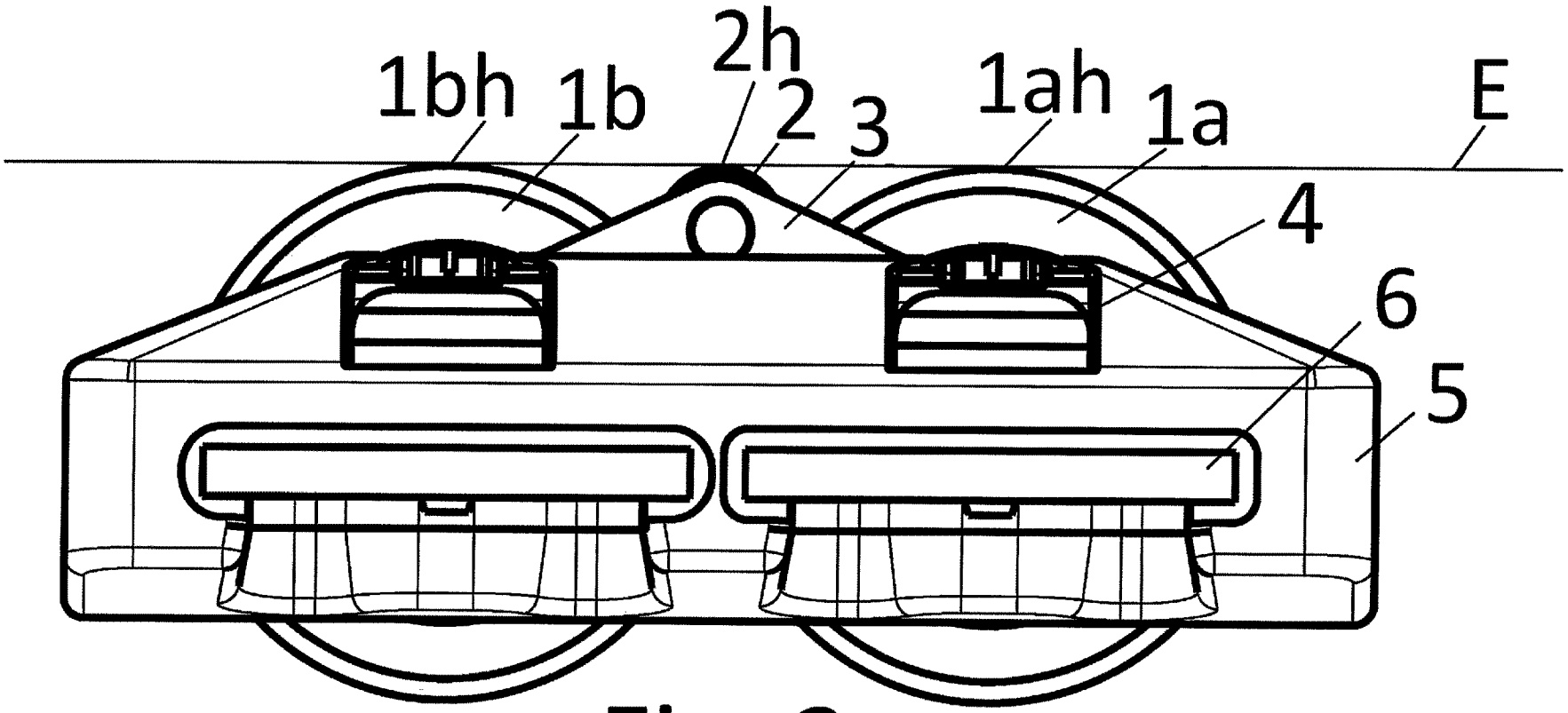
FIG. 3 shows a side view of the same embodiment.

FIG. 3 shows a side view of the embodiment of FIG. 1 and FIG. 2. It can be seen that the highest point of the shells of rollers 1*a*, 1*b* is at the same height as the highest point of the shell of intermediate roller 2. Furthermore, it is visible that the rollers 1*a*, 1*b* protrude from the carrier body 5 below the carrier body 5. This is a particularly simple and cost-effective construction method. However, it can also be advantageous to design the carrier body 5 in such a way that it encloses the rollers 1*a*, 1*b* on the underside since in this way sufficient clearance for the rollers 1*a*, 1*b* under the device need not be paid attention to.

Figure 4:
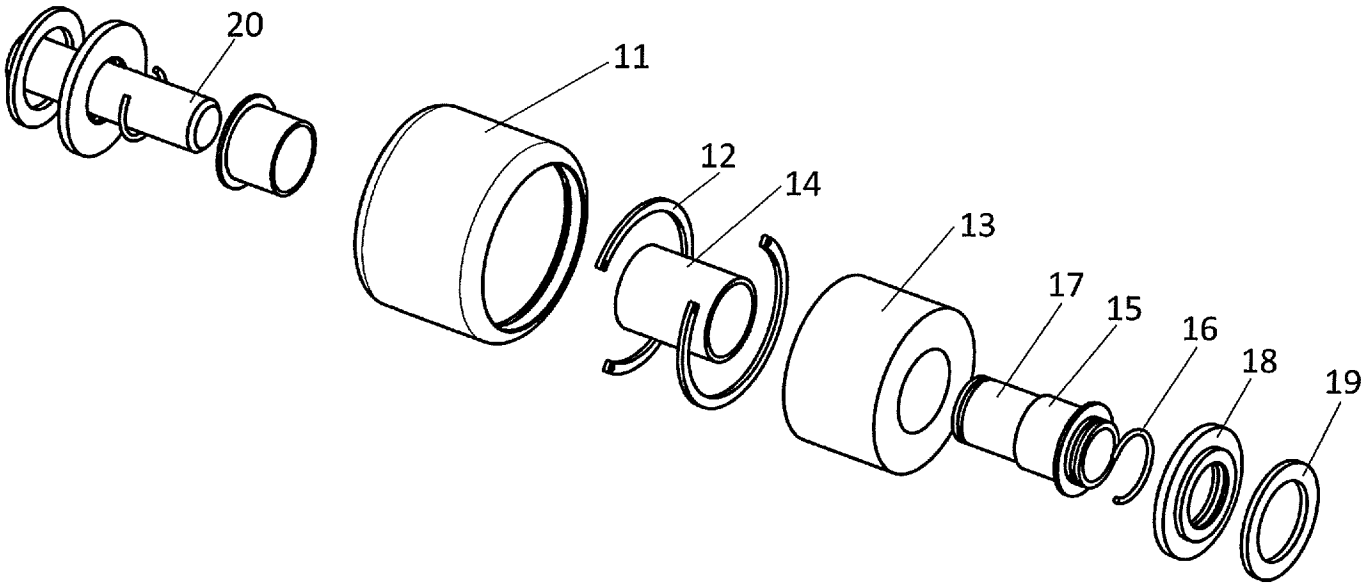
FIG. 4 shows an exploded view of an elastomer spring roller.

FIG. 4 shows an exploded view of a spring roller. Rollers 1*a*, 1*b* of this type can be particularly advantageous if leaf springs 6 as described in FIG. 1 are not used. The illustrated spring roller has an outermost shell 11. Inside there is a spring element 13 made of elastic material, preferably elastomer, flanked by two safety rings 12, which hold the spring element 13 in the outermost shell 11. The outermost shell 11 can be made of robust metal to prevent wear from rolling up the tongue rail. However, it can also be made of elastic material to provide additional damping. Inside the spring element 13 there is a fixing ring 14 as well as two limiting elements 15. The limiting elements 15 are arranged on a hollow shaft 17, which rests on shaft 20. Further safety rings 16, a disk 18 and a toothed disk 19 are arranged distally of the limiting elements 15.

The invention claimed is:

1. A device for moving a tongue rail of a switch, the device comprising:

at least two rollers, including a first roller and a further roller, which are configured and arranged one behind the other and substantially parallel to the rail course, and the at least two rollers are further configured and arranged to be acted upon by the tongue rail, the tongue rail rolling up from a lower contact position on a stock rail and directly in front of the first roller and onto the first roller, and rolling onto the further roller until it reaches a remote position;

at least one further intermediate roller, which is smaller than the at least two rollers, is positioned in a space between the at least two rollers; and wherein an axis of rotation of the intermediate roller is arranged essentially parallel to the axes of rotation of the at least two rollers;

wherein the at least two rollers and the at least one further intermediate roller are arranged on a common retaining device comprising two opposite metal elements, each with at least three holes configured to support shafts of the at least two rollers and the at least one further intermediate roller;

wherein the height of the axes of the at least two rollers is individually adjustable and the height of the axis of the at least one further intermediate roller is adjustable together with the at least two rollers by means of the common retaining device.

2. The device for lifting the tongue rail of the switch according to claim 1, characterized in that at least one of the at least two rollers are elastomer-sprung rollers.

3. The device of claim 2, wherein the at least one of the at least two rollers and at least one further intermediate roller includes an outermost shell made of metal.

4. The device for lifting the tongue rail of the switch according to claim 1, characterized in that at least one of the at least two rollers and at least one further intermediate roller includes an outermost shell made of metal.

5. The device of claim 4, wherein at least some of the at least two rollers and the at least one further intermediate roller are arranged on a common retaining device.

6. The device for lifting the tongue rail of the switch according to claim 1, characterized in that at least some of the at least two rollers and the at least one further intermediate roller are arranged on a common retaining device.

7. The device for lifting the tongue rail of the switch according to claim 6, characterized in that the retaining device includes two laterally arranged parts.

8. The device of claim 7, wherein the two laterally arranged parts of the retaining device are metal.

9. The device for lifting the tongue rail of the switch according to claim 1, characterized in that the device is configured and arranged between two sleepers and/or fixed on the two sleepers.

10. The device for lifting the tongue rail of the switch according to claim 1, characterized in that the device is fixed on the stock rail.

11. The device of claim 10, wherein the at least one further intermediate roller is arranged after the further roller.

12. The device for lifting the tongue rail of the switch according to claim 1, characterized in that the at least one further intermediate roller is arranged after the further roller.

13. The device of claim 1, wherein the at least one of the at least two rollers or at least one further intermediate roller includes an outermost shell made of metal.

14. The device of claim 1, wherein the device is configured and arranged between two sleepers and/or fixed on the two sleepers.

15. The device of claim 1, wherein the device is fixed on the stock rail.

16. A device for moving a tongue rail of a switch, the device comprising:

at least two rollers, including a first roller and a further roller, which are configured and arranged one behind the other and substantially parallel to the rail course, and the at least two rollers are further configured and arranged to be acted upon by the tongue rail, the tongue rail rolling up from a lower contact position on a stock rail and directly in front of the first roller and onto the first roller, and rolling onto the further roller until it reaches a remote position;

at least one further intermediate roller, which is smaller than the at least two rollers, is positioned in a space between the at least two rollers; and wherein an axis of rotation of the intermediate roller is arranged essentially parallel to the axes of rotation of the at least two rollers;

characterized in that the highest point of a shell of the at least one further intermediate roller is below the highest points of the shells of the at least two rollers.

17. The device of claim 16, wherein at least one of the at least two rollers are elastomer-sprung rollers.

18. The device of claim 16, wherein the at least one of the at least two rollers and at least one further intermediate roller includes an outermost shell made of metal.

* * * * *